United States Patent [19]

Gunderson

[11] Patent Number: 4,860,682

[45] Date of Patent: Aug. 29, 1989

[54] UNITARY-PANEL BOAT HULL CONSTRUCTION

[76] Inventor: Charles F. Gunderson, 1622 N. Marconi Rd., Belmar, N.J. 07719

[21] Appl. No.: 204,869

[22] Filed: Jun. 10, 1988

[51] Int. Cl.[4] ..... B63B 5/02

[52] U.S. Cl. ..... 114/358; 114/355; 114/359

[58] Field of Search ..... 114/355–359, 114/353, 354; 144/263, 350, 353, 355, 359, 360, 367

[56] References Cited

U.S. PATENT DOCUMENTS

| | | | |
|---|---|---|---|
| 2,220,875 | 11/1940 | Barker et al. | 114/358 |
| 2,232,313 | 2/1941 | Burch | 114/359 |
| 2,969,551 | 1/1961 | Snider | 114/355 |
| 2,980,153 | 4/1961 | Burch | 114/358 |
| 3,295,152 | 1/1967 | Shelley | 114/358 |
| 4,282,617 | 8/1981 | Lundstrom | 114/355 |

*Primary Examiner*—Joseph F. Peters, Jr.
*Assistant Examiner*—Edwin L. Swinehart
*Attorney, Agent, or Firm*—Charles F. Gunderson

[57] ABSTRACT

A displacement hull is formed by making a series of cuts in a single sheet or panel of semi-resilient material. At least one primary cut begins at one end of the panel, and extends in one direction for a substantial distance along the panel, but terminates within the panel. At least one primary cut in the other direction runs substantially-parallel to the primary cut in the one direction and overlaps it for a substantial length of the hull. The panel must have enough resilliency, and the cuts from opposing directions must be long enough to provide at least one, elongated, relatively-narrow, very-flexible strip, within which the panel develops from a flat surface, at the termination of each of the primary cuts, to any desired angle at the start of each cut. Secondary cuts, curving away from the primary cuts along the flexible strip, in either direction, can provide various cruves to the keel or chines. Additional, tertiary cuts, curving away from the primary or secondary cuts, at or near their terminations, in the general direction of the primary cuts, east the stress in the panel at the termination of the cuts. The edges of the adjacent portions of the beginnings of the primary and secondary cuts, which should be congruent, are drawn together and sealed in a watertight manner to make the hull.

10 Claims, 3 Drawing Sheets

101
102
102A
103
104
105
107
107A
108
109P
109S 121
122
122A
122B
124
125
127
127A
128

141
142
142A
142B
142C
142D
144
144B
145
147
149P
149S 111, 121, 131, 141
150
151

191
192
192A
193
194
195
196
196A
198

111
112
112A
112B
114
115
116
116A
118

131
132
132A
132B
132C
134
135
136
136A
138

UNITARY-PANEL BOAT HULL CONSTRUCTION

CROSS REFERENCE TO RELATED APPLICATIONS

This patent application is a substitute of the U.S. Pat. application, Ser. No. 878,135, filed 06/25/86, now abandoned for a UNITARY-PANEL BOAT HULL CONSTRUCTION, Which is a continuation-in-part of the U.S. Pat. application Ser. No. 703,224, filed 02/19/85, now abandoned, by the applicant Charles F. Gunderson.

BACKGROUND OF THE INVENTION

There are innumerable types of small boats, and almost as many ways of making them. With the advent of dressed lumber, hull forms could be ribbed or framed and planked to form a hull. However this produced an array of seams that had to be caulked and filled to try to reduce leaking, and only after weeks of immersion and swelling of the wood did the hull become reasonably tight.

The development of waterproof plywood simplified and improved boat building by forming panels without seams over the larger surfaces, particularly for "V" bottom or hard chine hulls, and only the chines, keel, stem, and transom had to be caulked. This provided a very much tighter hull with fewer and more manageable seams that could be made watertight with reasonable skill and care. However, even these boats required preset jigs, frames or ribs around which the plywood panels were drawn or fitted to form the hull.

A few full forms have been suggested that, with carefully cut panels, precisely drawn together along the edges of the cuts and fastened together by one means or another, will form a hull without the need for jigs and frames, or ribs preset to receive the panels. However, these still rely on separate pieces of plywood, precut in the form of the bottom and side panels, to be bent or curved, secured together, and attached to a transom and bow piece to form a boat hull.

Moreover, while these separate panels can be bent or curved, or even twisted, to a limited degree, to follow a bottom or side configuration, they can only be curved in one plane in any given portion of one panel. The panel inherently refuses and rejects curves in the longitudinal and lateral directions simultaneously.

A few innovations have been made to achieve secondary bends and curves. Slotting a panel at one end can form a "V" at the bow of an otherwise flat or slightly-curved stern in a single panel to use one panel instead of two and to be able to curve the plywood in two planes to form the bottom of the hull. This is seen in many patents such as that of No. 2,232,313, to Burch whose bottom panel is illustrated in FIG. 1 of the prior art.

Pat. No. 4,282,617 to Lundstrom, shown in FIG. 2 of the prior art, carries this one step further by providing cuts on either side of the panel aft to form side panels as well. However, anyone skilled in the art, who has worked with plywood, must know that cuts such as these can only be effective in very flexible materials, and only ease the curving of the panels to a limited degree.

It should be stressed that none of Lundstron's cuts overlap. While he shows cuts in the bow section 21, and in the stern sections 22, as well as amidships, not one of the cuts overlaps, even slightly, a cut coming from the opposite direction; nor are the cuts even close together.

The essence of the subject invention, as will be made quite clear in the following disclosure and claims, is not only a technical or accidental overlap of cuts from opposite directions, but an extensive overlap producing a distinct, relatively-narrow, strip of material that must have a tangible length-width relationship for a given bend.

While each of these references improves the state of the art, and adds resiliency and more compound curves in a given panel, neither of these patents—nor any in the prior art—provides any teaching, or suggestion, or even accidental disclosure of the overlapping cuts or compound cuts that are the essence of this invention.

It is therefore an object of this invention to provide a boat, and a method for building the boat, that requires an almost irreducible outlay of materials, time, and skill.

It is a further object of this invention to provide a boat that can be formed and constructed from a single sheet, or a few sheets of plywood, without molds or jigs, in a few hours, by a person of average skills.

It is a further object of this invention to provide a novel way of cross-cutting panels axially to provide a single unit that can be formed into a hull.

It is a further object of this invention to provide a small boat, and a method for making the small boat, that can be formed from a single panel of semi-resilient material, such as plywood, by certain cuts that permit the panel to be folded beyond its normal resiliency, into a hull form.

It is a further object of this invention to provide a method of making a small boat, and a boat, that can be formed from cuts made in a single panel of plywood, that includes the transom, as well as the sides, bottom, and stem. These and other objects will become apparent from the following summary, specification, and drawings.

SUMMARY OF THE INVENTION

At least two cuts are made in a piece of resilient paneling. One primary cut is made, starting at one (bow) end towards, but terminating before reaching, the other (stern) end. The other primary cut is made, starting from the other end, towards, but terminating before reaching, the one end. These cuts must overlap each other for a substantial distance to provide an elongated, comparatively-flexible strip. The length of the overlap is a function of the resiliency of the panel, and the angle to which the outer portions of the panels are to be bent or formed. After cutting, the outer portions of the panels can be brought up towards each other to provide a structure in the form of a hull.

Secondary cuts may be provided, beginning near the terminating points of the primary cuts, and following, or forming the chines on either side. Additional cuts may be made to provide additional flexible strips to ease the bending of the panel or change the contour of the hull where necessary or desirable.

DETAILED DESCRIPTION OF THE DRAWINGS

Figure 1:
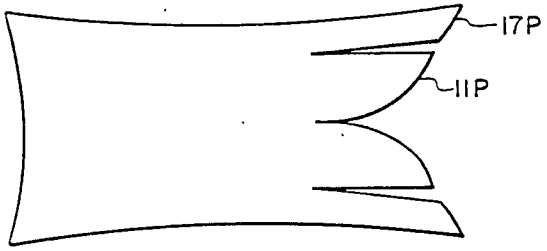
FIG. 1 (Prior Art)

Refering now more particularly to FIG. 1, a plan view of a hull is shown, as taught by Burch, in Pat. No. 2,232,313. This shows the state of the art in the use of tapered cuts 11*p* and 17*p* in a panel to ease the end of a panel into a bow shape.

Figure 2:
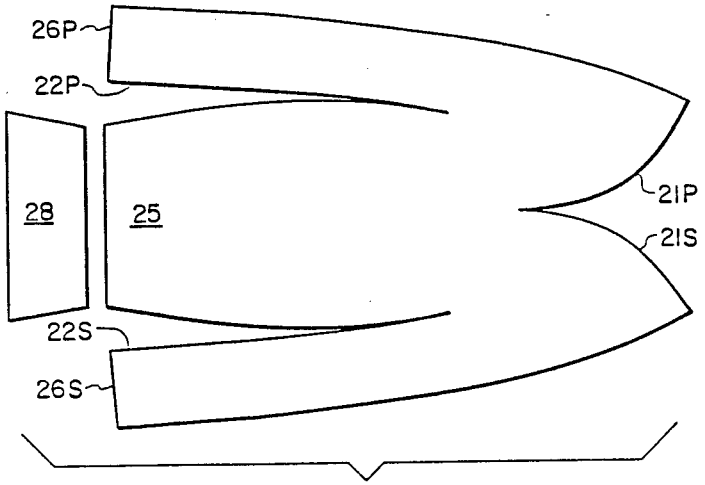
FIG. 2 (Prior Art)
FIGS. 1 and 2 are typical examples of the prior art.

FIG. 2 shows a somewhat more complex hull form, as taught by Lundstrom in Pat. No. 4,282,617. This has, in addition to the bow cuts 21, a pair of cuts 22, aft, on either side of the bottom 25, to form into sides when attached to the transom 28.

Figure 3:
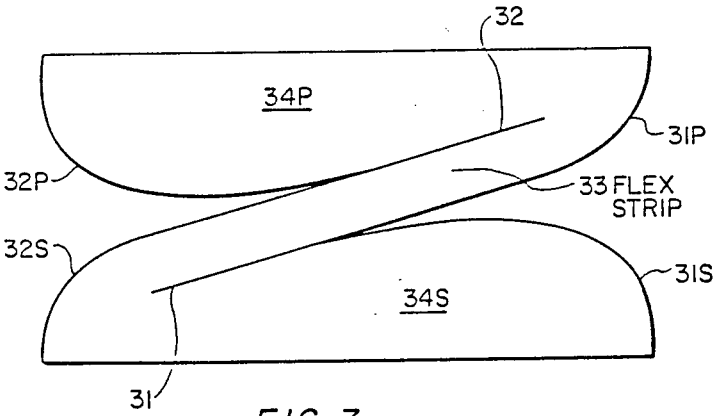
FIG. 3 shows a basic asymmetrical pontoon.

FIG. 3 shows a basic, asymmetrical pontoon according to this invention, with a bow cut 31 dividing into curves 31P and 31S to become the port and starboard sides of one end of the pontoon, and a stern cut 32 dividing into curves 32P and 32S forming the port and starboard sides, respectively, of the other end of the pontoon.

It is possible, in some cases, to bend the plywood with a single primary cut from a forward point running aft, and a single, primary cut from an after point running forward, with both cuts overlapping each other for the substantial distance necessary to form and adequate flex strip. However, for esthetic as well as practical reasons, a first, primary cut would be curved as in 31P to produce a conventional bow shape, and a secondary bow cut, such as 31S would have to be curved in such a way that its edge follows the same curve as 31P when the two sides of the bow are drawn up for fastening and sealing in a watertight manner. The same would apply to the stern cuts.

These primary and secondary cuts must merge tangentially, or effectively asymptotically into a single cut that must extend for a substantial distance from the junction of the curves to reduce the stress at their terminal point and make the bending of the panel possible to form the hull without fracturing the panel.

Stress at the termination of the single cut, whether it is the primary cut, or elongated junction of the primary and secondary cuts, is critical. It can be sufficiently relieved, in most situations, by lengthening the cuts, or overlapping the cuts. However, where lengthening of the cuts, or overlap, is not practical, the stress can also be relieved by tertiary cuts, such as the tapering cuts 42A of FIG. 4; the fork cuts 69A of FIG. 6; or the fan cuts 79A of FIG. 7 that can relieve the stress by spreading it over a wider portion of the panel.

It is, in practice, not quite possible to predict an adequate length for the single cut, or tangential junction of the single cut to extend, or the length of the overlap of these common, terminating cuts, since the flexibility of the cut panel is a function of the length and width of the common flex strip, and, even more so, the thickness and physical characteristics of the panel material. With this method, however, the cuts can usually be made longer, or the strip narrower to achieve the necessary bends and twists in the panel. However, if this is not possible, or if it is more practical, the tertiary cuts described above, or blind cuts can solve the problem.

The elongated, relatively-narrow strip 33 between cuts 31 and 32 forms the essential easily-twistable portion of the panel that separates, yet joins, the side panels 34P and 34S, forming the port and starboard sides of the pontoon. The flex strip 33 must be long enough, and narrow enough to accomodate as much as an 180 degree twist from one end of the strip to the other. One or more of such flex strips between axial cuts from opposing ends of a panel will be necessary in each variation of hull to be built by this method.

Figure 4:
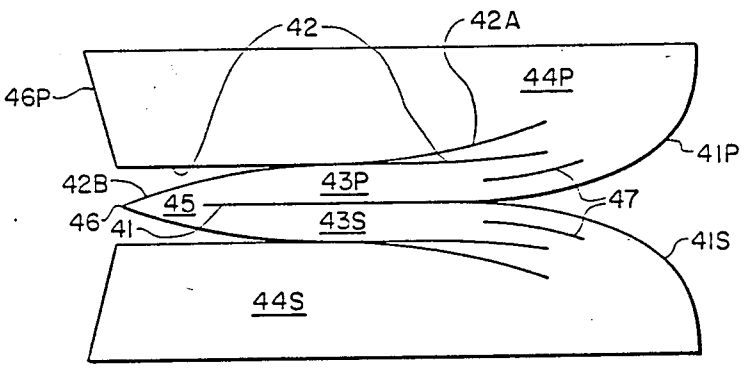
FIG. 4 shows another, symmetical pontoon.

FIG. 4 shows another pontoon, this time symmetrical, with the cut 41 along a central axis, and dividing into curves 41P and 41S, to become the port and starboard sides of the bow of this pontoon. The adjacent, substantially-parallel chine cuts 42 on either side of the cut 41, form a pair of flex strips 43P and 43S to absorb, and divide the nearly 180 degree twist as the side panels 44P and 44S are pulled up into with similar cuts on the starboard side, are curved to bring the after ends, such as 46P, to a point 46.

On the other hand, the dividing cut 42B, for example, could be eliminated, and a transom, not shown, could be provided between the bottom panel 45 and the ends 46 of the side panels.

While the flex strips 43P and 43S can be cut narrow enough to easily make the bend or twist to bring the side panels up, there is always some stress at the beginnings of cuts. This may be reduced or shared by tapering fork cuts or fan cuts, such as 42A off any of the terminating cuts. Blind cuts, such as 47 can also ease the stress in a given area of the panel. Holes, not shown, may also be drilled, in a well known manner, at the start of each cut to reduce fracture.

In this case, as in all the previous figures, it is presumed that the cuts 31 and 32 as well as 41 and 42, and all similar cuts, will be pulled together and sealed in a waterproof manner by any of the available means, well known in the art. A glue or resin, preferably reenforced with a fiberglass cloth would be an obvious choice for this.

In shorter hull lengths, the species of FIGS. 3 and 4 may be considered pontoons, and would be excellent for use in catamarans or trimarans, since to perform applicant's functions and produce his novel hull, the width of the flex strip must be a small fraction of the length between the cuts. However, if the hull were lengthened, and the side panels lowered, the strip might become wide enough to become a single hull. For example, if the panels shown were of typical available four by eight foot panel of quarter inch plywood, the flex strip could not be more that a foot or so wide, which would not provide a stable hull. On the other hand, if the hull were doubled or trebled in length, by butting or scarfing ends of panels together, the flex strip might be extended to three or four feet in width to provide a form of canoe or kayak.

In this regard, a most important variation of this and all of the remaining symmetrical hull types, is in the extending of the lines, such as 42, to join lines and cuts from an identical, mirror-image cut panel, with their after bottom ends, such as 45, butted or scarfed stern-to-stern to create a double-ender or canoe type hull. Two units of FIG. 4, for example, could have square sterns, as noted earlier, that could be butted against each other to form a symmetrical, double-ended hull, or even a type of canoe.

As noted earlier, additional cuts, such as blind cuts 52B, are part of this concept to ease the stress in a given part of the plywood bearing too much of the torque, or to improve the lines of the final hull.

Figure 5:
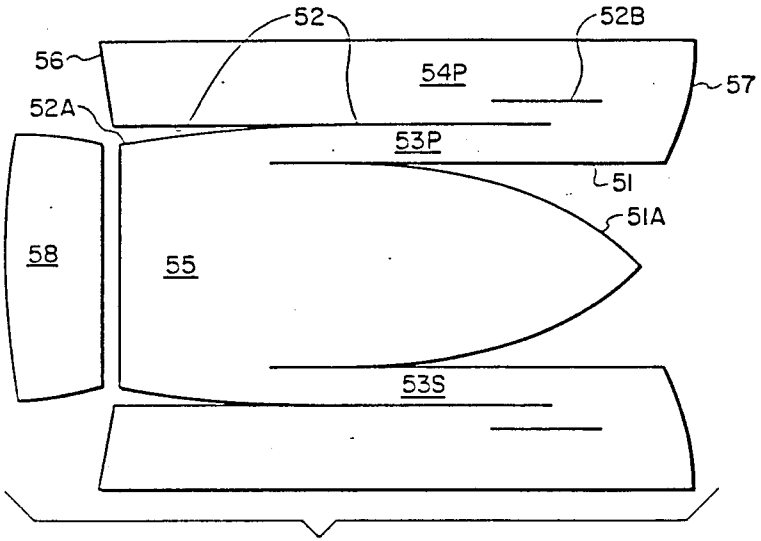
FIG. 5 shows a conventional hull of this type.

A more practical variation, and a viable little boat, is illustrated in FIG. 5. This has a pair of flex strips 53P and 53S but widely separated by a bottom panel portion 55. Here we have cuts, such as 51, outside and 51A inside on both port and starboard sides forming the bow chines and the cuts such as 52, outside and 52A inside, on both port and starboard sides forming the after chines. The wide bottom panel 55 now needs a transom 58 to terminate it and the ends 56 of the side panels 54. Since the cuts 51 now terminate in a bow point, a specific pair of cuts 57 must extend from that point to shape a conventional bow.

In this, as in the hull of FIG. 4, and any of the following, the cuts 52 may be made parallel, and the transom omitted, to be butted against an identical, mirror-image unit to form a double ender.

Figure 6:
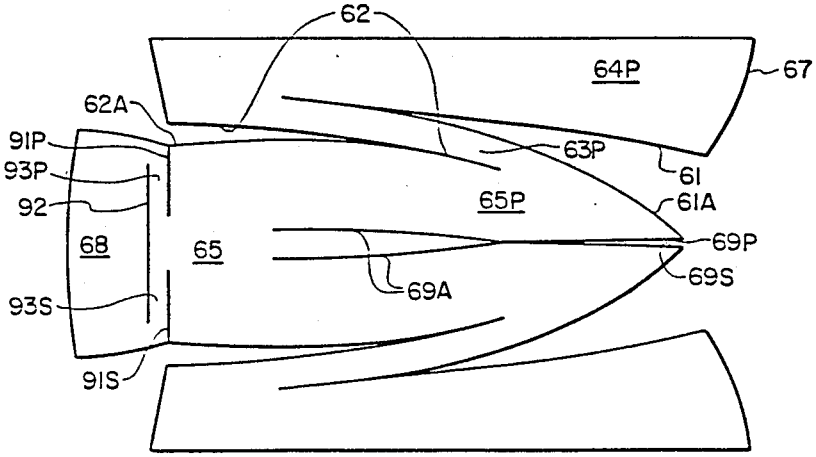
FIG. 6 shows another variation of these hulls.

FIG. 6 shows an extension of this hull concept wherein the transom is also formed from the integral panel by cuts perpendicular to the axis of the hull, overlapping in the same manner, and in the same general proportions, but necessarily at a smaller scale, since the distances must be shorter. Here the elements, and cuts of FIG. 5, and the basic concept in general are recognizable, and are similarly numbered. The bow chine cuts 61 overlap the after chine cuts 62 to form the port and starboard flex strips 63. The port and starboard side panels 64 join along the bow cuts 67 to form a sharp bow, and the after sections 66 attach to the transom portion 68. However, here the transom is still a part of the main panel, and folds up from the bottom portion 65 by means of the port and starboard cuts 91P and 91S and the closely overlapping cut 92 that forms the essential flex strips 93 on either side.

FIG. 6 also adds an axial cut that separates into 69P and 69S in a very narrow spacing. This adds a very graceful, elongated "V" bow. This could be continued straight aft—as in 89P and 89S in FIG. 8—to disappear into a flat or gently rounded stern portion 65. Here the plywood would be flexed slightly in opposing planes, but not enough to need the flex strips such as 63 that are essential to the sharp bends made possible by this concept of boat building. However, while the stress may not be great at this junction, the bending is eased and the shape of the bottom improved by dividing the stress between fork cuts 69A.

Figure 7:
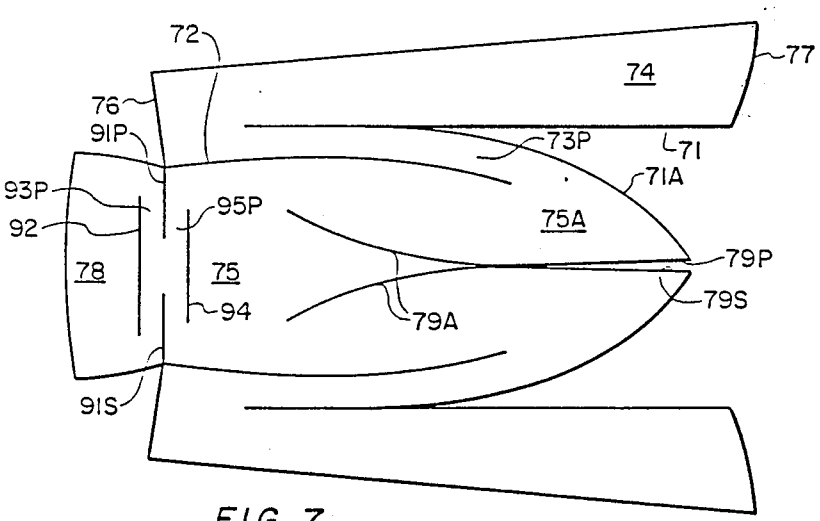

FIG. 7 is an extension of the concepts of the earlier hull forms. Most of the elements of the earlier forms are seen here and are similarly numbered. A significant feature here is in the after chine cut 72 not dividing as it moves aft. This is quite desireable in the hull concept in producing as good, or better, hull form with one less cut. An additional cross cut 94 on the other side of and close to the cross cuts 91, provides additional flex strips 95 to reduce the strain on the flex strips 93. The cross cuts 91, 92, and 94 are single cuts, since their function is the same as it would be with divided cuts, however, divided cuts, or difference curves can be used to alter the contour of the transom curves, as they do in the bow and other curves. FIG. 7 has central bow curves 79P and 79S similar to those of FIG. 6. It also has terminating fan curves 79A spreading wider toward the after end of the bottom to change the bottom contour somewhat.

Figure 8:
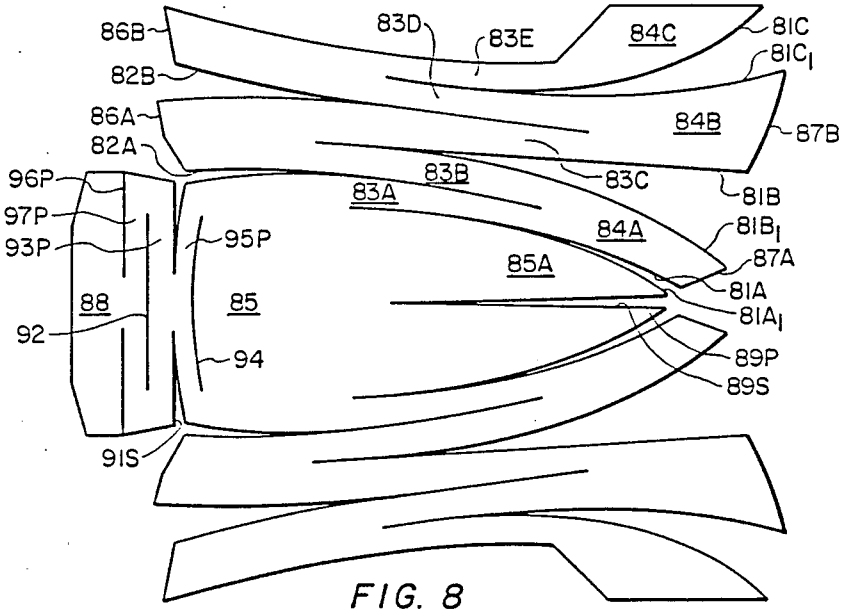
FIGS. 7 and 8 show other variations of these hulls.

This basic concept anticipates the possibility of very many overlapping fore and aft axial and cross cuts, and as many flex strips as may be advantageous to produce more complex curves, and approach a more rounded hull form. In FIG. 8, the basic, original cuts and forms can be seen, but they are augmented by additional cuts, and additional flex strips, fore and aft, to produce more complete, yet complex hull forms. FIG. 8 shows, for example, a lower portion 84A, of the bow side panel below the main bow side panel 84B. This provides an additional flex strip 83B above the basic flex strip 83A between the basic cuts, now 81A and 82A. An additional cut 82B, from the stern, can be labeled a gunwale cut, since the ensueing panel folds over the top of the transom at 86B to form an after deck. In the same manner, still another bow cut 81C becomes a gunwale, rather than a chine, and forms the fore deck 84C. We then have a succession of flex strips 83A–E, on either side of the hull, wrapping the panel into a complete hull, including a deck. The transom in FIG. 8 is also expanded to include additional cross cuts 96 providing additional cross flex strips 97. Here too the basic cuts 91P and 91S are show separated, to provide a curving in of the transom and hull junction at this point.

While the basic hull forms shown are basically to scale, it is obvious that these proportiones may be lenthened, or shortened; expanded or contracted without changing the basic concepts taught here. The basic medium here could be a simple piece of four by eight foot marine plywood, or its equivalent in any form of material. Longer and larger sizes of sheets are, of course available, and the available sheets can be scarfed, or butted together in a well known manner to provide panels of any desired size. Mechanical and practical considerations would, of course limit the ultimate sizes. The thickness of the plywood must also be taken into consideration. Quarter inch marine plywood is quite adequate for hulls 8 to 10 feet long, or, if well braced, even longer. However, it is conceivable that thicker and stronger types of plywood, securely bonded together, could be adapted to these techniques for even larger hulls.

The flex strip, again is the essential feature of this invention. In a panel of four by eight foot plywood, for example, bow chine cuts, and stern chine cuts could overlap each other by a matter of inches. A strip of sound ply wood, only a few inches wide can be twisted 90 degrees within a foot or so, and comparably more in longer lengths. The wider the flex strip, the longer it must be to absorb the twist without fracturing. These flexing abilities will vary considerably between types and manufacturers of plywood. The type of wood and the relative thickness of the various layers will also effect the twisting potential, and superficial faults or core voids would, predictably, invite fractures. A good, flexible plywood can tolerate unbelieveable bends, to provide an almost rounded hull form, but even an economy plywood, with conservative design and cuts can make a very satisfactory hull. In fact, minor fractures during the forming of these hulls can be reenforced until the gluing stage is completed when it may not even be noticeable.

The object of this method of making a hull, is not to produce a hull so different and unnatural as to be unique, but to provide a method for building a small boat hull that is of a very acceptable size and shape, seaworthy, and buildable with basic, readily-available, inexpensive materials. In an era when fiberglass boats, that are very expensive, and impossible for amateurs to build seem to dominate the boat field, it is intended to provide a means and method for an amateur to build a very attractive little boat from readily available materials, at a fraction of the cost of a fiberglass boat. More important, it is a method for building a boat that is so simple and unique that an amateur can build it about a day from plywood panels to finished hull. It is probable that many people who cannot afford a fiberglass boat—and there is almost nothing else on the market—would welcome such a project.

While the FIGS. 3 through 8 show basic hulls with elongated primary cuts through the panels in both directions, overlapping to provide the necessary flex strips, these figures show almost as many secondary cuts, also in both directions to control the shape of the hull. These all leave long seams or chines to be drawn together and held while the seams are glued, sealed, and reinforced.

It is, of course, obvious here, as was noted earlier, that the seams must be drawn together as tightly as practical to minimise the gluing and filling of the seams. Ideally, the seams could fall naturally together, and stay in alignment during the gluing, filling and sealing of the seams. However, to be realistic, in practice, some pressure may be necessary to draw the seams together, particularly where more difficult curves and shapes are attempted.

Ropes, clamps, and wedges, or even jigs may be used to draw the seams really tight, and wire ties may also be added to draw in and to hold the seams or chines together long enough for a glue to set. One must not risk a shift in the bracing while the glue is setting.

In the case of the through cuts of FIGS. 3–10, after the initial gluing of the inside of the seams, rough seams are left on the other side of the panel that must be rasped or rough sanded to round the chines for filling and final sanding before they are glued and reinforced to seal and finish the outer hull. Of course, even with these steps, this hull is far simpler to construct than most hulls available for amateur construction.

Yet for certain hull forms, it is possible to reduce many of the secondary cuts and further simplify the hull. For example, in the species of FIGS. 9 and 10, there are only single secondary cuts 192A and 102A, and these are pure arcs tangent to their primary cuts. Another feature, that could be noted, and is possibly unique in boat design, is that all of the other cuts—except the transom and bow fillers—are straight lines. However, these through cuts still leave rough edges projecting on the outside that have to be rasped, rounded, filled and sanded on the outside, which is time consuming, for a workman-like job.

This chore has been reduced considerably by the elimination of almost all the rough edges by means of partial cuts in the species of FIGS. 11–14, that will even reduce the rounding and filling of the seams on the other side. This technique, and features will be described in due course.

The hull forms that are designed to eliminate most of the secondary cuts are shown in the FIGS. 9 through 14. Eliminating secondary cuts, along with curves as well simplifies the layout, the cutting, and the assembling of the hulls to improve overall construction.

These FIGS.,9 to 14, to save space, are shown in quarter sections of the port sides, with an implied mirror image for the starboard sides. The "P" and "S" have been mostly omitted, and the numbering scheme has been changed slightly to suggest the junction of the fore and aft quarters.

These species that may be joined fore and aft, have, in effect, added a central chine cut—or changed a fore or aft chine cut into a central chine cut. This is suggested and stressed earlier for the joining of hulls, stern-to-stern to form a double-ended hull, particularly for the FIGS. 4 through 8, where it is noted that the inner cuts may be made parallel to the axis of the hull, and the transoms omitted to butt the panels against each other to form the double-ended hulls.

In FIGS. 9 to 14, for example 192A, 102A, 112A, 122A, 132A and 142A, may be parallel the axis of the hull amidships, so that a mirror image of that quartering—or any of the optional quarterings, or similar designs—may be butted or scarfed amidships to the other end of the panel fore and aft on both the port and starboard sides of the panel for very-many variations of hull forms.

Figures 9, 10, 11, 12, 13, 14, 15:
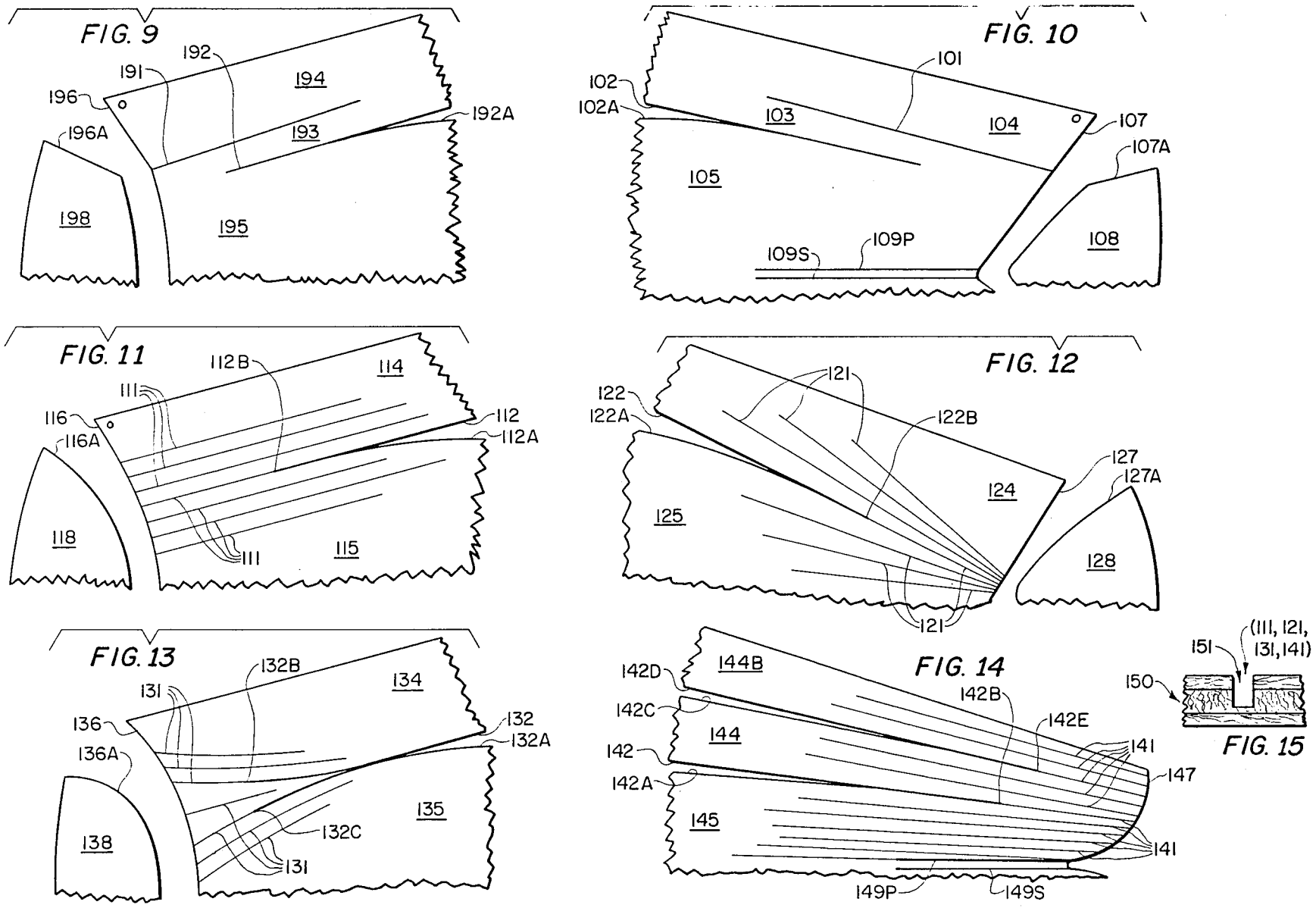
FIGS. 9 and 10 show partial views of simplified hull sections.
FIGS. 11 through 14 show partial view of still-more simplified hull sections.
FIG. 15 shows a cross section of partial cuts.

FIG. 9 shows a variation of a stern, such as that of FIG. 5—which has the after chine outside of the bow chine cut—but without the secondary cuts, as seen also in FIG. 7, with the cuts reversed. This leads up to the omission of the secondary cuts in the most parts of FIGS. 9 through 14, to significantly simplify the lay-out and cutting of the hull panels as well as to simplify the construction and provide interesting variations in the hull.

In FIG. 9, which is intended as a stern section, an after primary cut 191, through the panel, overlaps primary and secondary cuts, 192 and 192A, also through the panel, to provide a flex strip 193 to separate the side panel 194 from the bottom panel 195. But here the through cut 191 has no secondary cut and there is no keel cut. The bottom panel is 195, and the transom end 196 of the panel is joined to the side 196A of the transom 198 when the hull is drawn up.

In FIG. 10, which is intended as a bow section, to be joined to a stern section such as seen in FIG. 9, the bow cut 101 and the keel cuts 109P and 109S, through the panel, also have no secondary cuts. Only the cut 102 has a secondary cut 102A to round the center portion of the hull. This simplifies the drawing up of the ends, such as 107, of the side panels; in this case along the sides 107A of the bow piece 108 to form a pram-type of bow. The important factor of the hulls of FIGS. 9 and 10 is that, with only one secondary cut, the edges of the cuts stay together, and can be simpler to fasten. In this figure, the essential flex strip 103 is seen between the side panel 104, and the bottom panel 105.

This leads to the concepts of FIGS. 11 through 14, where the secondary cuts are, again, virtually eliminated except for the 112A, 122A, 132A, and 142A. Since the opposing primary cuts can be mostly linear, and no slices of wood are being removed, these opposing primary cuts can be partial cuts, such as 151 shown in the cross section in FIG. 15,—and indicated here in lighter lines—that do not go all the way through the panel.

These partial cuts are exacting, but not necessarily difficult or critical. For cutting, the panel should be on a flat surface, and the depth control of the saw must be precise. In the case of $\frac{1}{4}$ inch plywood, which is the more obvious—but not the only—choice of material for this concept of boat building, one should cut nearly through the first two plys. Shallower, as well as deeper cuts may be used, but shallower cuts will be more difficult to bend and provide less of an angle, and deeper cuts risk fracturing the seam with the sharper bends they make possible.

Other factors are important, if not critical. While the earlier variations of this concept taught the axial overlapping of the fore and aft primary through cuts to form the flex strips, it will be noted that all, repeat, all of the primary partial cuts, and their opposing primary through or partial cuts must be diagonally across the plywood. An axial partial cut, in plywood, would very-probably split when bent.

These partial cuts, actually, cannot accomodate the chine angles of over 90 degrees that are quite feasable with the through cuts. However, with a wide, carbide, blade, these partial cuts will permit as much as 10 to 20 degrees of bending along each partial cut. This will, of course, vary with the type of wood, its quality, and its moisture content, but additional partial cuts, side by side, can provide as many increments as are necessary for additional bending of the plywood.

In any case, more partial cuts will be needed to achieve the bend of a single through cut. The number of cuts will determine the amount of bend that is feasable, and the spacing of the partial cuts will influence the curvature. The more cuts that are made, the closer the spacing, and the deeper the cuts, the sharper the curve, and vise-versa. The wider spacing of the partial cuts 111 of FIG. 11 will provide the gentle curve 116A along the side of the transom 118, whereas the narrower spacing of the partial cuts 121 near the bow of FIG. 12 will provide a sharper curve.

Instead of a single flex strip, such as 103, we now have a plurality of narrow flex strips between the primary partial cuts, such as 111, overlapping the other primary through cut 112 at the start of the opposing through cut.

FIG. 11 shows one version of a transom. Here the multiple partial primary cuts 111 overlap the single, opposing, through, primary and secondary cuts 112 and 112A. These primary and secondary through cuts form a hard chine amidships and define a side and bottom panel 114 and 115, while the partial cuts 111 along the transom provide an easy curve along 116 joining the edge 116A of the transom 118.

FIG. 12 shows another variation that is more suitable to a bow, and can, obviously, be combined with a transom, such as that of FIG. 11, along with their starboard sides, to form a hull. Here the multiple, primary, partial cuts 121 are focused toward the bottom of the bow to provide a much-sharper curve near the bottom of the side panel for sharper entry into the water. The bottom of the bow piece 128 can be curved to conform to the curve at the bottom of the side panel end 127, to join the side 127A of the bow piece 128. The primary, partial cuts 121 overlap the other primary through cut 122 on both sides to form as many, mini flex strips. The secondary, through cut 122A forms the central curve of the hull for the side panel 124 around the bottom panel 125.

FIG. 13 shows how the tertiary fan cuts 132B and 132C—such as seen in earlier figures, for reducing stress by expanding the termination of the primary and secondary cuts—can be added to the primary and secondary through cuts 132 and 132A opposing and overlapping the multiple partial cuts 131.

Here, again, the end 136 with its partial cuts will form around the edge 136A of the transom 138, and the other primary through cuts 132 and 132A will form a hard chine to divide the side panel 134 and the bottom panel 135.

FIG. 14 shows still another version of partial primary cuts 141 overlapping the opposing primary and secondary through cuts 142 and 142A to form the side panel 144 and the bottom panel 145. The intent here is to provide enough partial cuts, and extend the bow enough to provide a vertical bow—rather than a pram bow—with or without a skeg.

Actually, the strip between 149P and 149S could be extended (not shown) with crosswise partial cuts close enough to let it follow the curve of the bow. A taper outward would provide an interesting variation of a pram bow, but would interfere with the deck of this species.

Another feature here is the addition of primary through cuts 142C and 142D, forming a gunwale between a deck panel 144B and the side panel 144. With the opposing primary partial cuts 141 overlapping on both sides or the primary through cuts 142C and 142D to form partial flex strips to curve around the deck panel 144B. However, in this case the upper portion 144B folds over, in a manner similar the that of the hull of FIG. 8, to provide a deck. This, combined with a similar or compatible end portion, would be and ideal rowing scull.

FIG. 15 shows a cross section of a portion 150 of a panel, such as plywood, with a partial cut 151, such as suggested for any of the partial cuts, such as 111, 121, 131, 141. The cut must go through the first ply, and almost through the inner ply to be effective. However, the relative thickness of the plys and the characteristics of the plywood should be considered here. The deeper the cut, the easier the bend, but the more chance of fracturing the seam.

While the hulls of FIGS. 11–14 are specifically designed for partial cuts, it should be understood that any portion of any section of any of the FIGS. 3 through 10 where there is no secondary cut or the angle of the bend is within the tolerance of the plywood can use partial cuts instead of through cuts. The tertiary cuts could—and should—also be partial cuts. The through primary cuts can also be extended by partial cuts as seen in FIGS. 11–14. The partial cuts need not be straight, as shown here, but may be curved to some extent for slight variations in the hull shape.

I claim:

1. A displacement hull formed of a single, elongated, flat panel of resilient material, said panel having a bow end and an aft end comprising at least one, basic, bow, primary cut in said panel, said bow primary cut extending from said bow end of said panel towards said aft end of said panel to a basic terminating point before reaching said aft end of said panel; at least one, opposing, aft, primary cut in said panel beginning from said aft end of said panel, and extending towards said bow end of said panel, to an opposing terminating point before reaching said bow end of said panel; said basic, bow, primary cut and said opposing, aft, primary cut overlapping each other for a considerable distance to form at least one, elongated, relatively-narrow, centrally-located, inner, flexible strip between said basic and opposing primary cuts within said panel; said panel having one outer portion along said basic, bow, primary cut and another outer portion along said opposing, aft, primary cut that can be bent to any desired angle with respect to each other and said inner flexible strip; said basic, bow, primary cut and said opposing, aft, primary cut forming edges that are adaptable to be drawn together and secured in a watertight manner to form a bow and a bow chine, and a stern and stern chine, respectively, for said displacement hull.

2. A displacement hull, as in claim 1, wherein said opposing, aft, primary cut is joined by an opposing secondary cut extending from said opposing terminating point, and gradually and smoothly drawing away from said opposing aft primary cut to shape said after end when said edges of said panel are drawn together.

3. A displacement hull, as in claim 1, wherein said basic, bow, primary cut is joined by a basic secondary cut; said basic, bow, primary cut curving near said bow end of said panel into a bow curve in one direction, and said basic secondary cut curving near said bow end into a mirror-image curve to join said basic, bow curve when said bow edges of said panel are drawn together.

4. A displacement hull, as in claim 1, having one or more tertiary cuts, at or near one of said terminating points, curving outwardly from one of said primary cuts to relieve the stress on the panel around said terminating point.

5. A displacement hull, as in claim 1, having a plurality of basic, bow, primary cuts overlapping said opposing, aft, primary cut, on either side of said opposing, aft, primary cut to produce, in effect, a series of bow chines gradually curving said bow from one side to the other.

6. A displacement hull, as in claim 5, wherein said plurality of basic, bow, primary cuts are partial cuts, cutting part way, but not all the way, through said panel, and said tertiary cuts are also partial cuts.

7. A displacement hull, as in claim 5, wherein said plurality of basic, bow, primary cuts radiate from a location near the keel portion of the bow end to concentrate said series of bow chines in a small area, and produce a sharper bow.

8. A displacement hull, as in claim 5, wherein said primary cuts may be extended past said terminating points by partial cuts.

9. A displacement hull, as in claim 1, wherein said basic, bow, primary cut, and its opposing, aft, primary cut is on the port side of said hull panel, and a mirror image of said basic, bow, and opposing aft primary cuts are made on the starboard side of said hull panel to form a wider hull with more flexible strips and less bending.

10. A displacement hull, as in claim 1, wherein said basic, bow, and opposing, aft, primary cuts have mirror-image cuts from the aft end of said hull panel with said opposing primary and secondary cuts joined to provide a curve for said centrally-located portion of said hull.

* * * * *